US005704374A

United States Patent [19]

Abrahamsson

[11] Patent Number: 5,704,374

[45] Date of Patent: Jan. 6, 1998

[54] HAND-DRIVEN WOOD SPLITTER

[76] Inventor: Clas Abrahamsson, Tegvägen 1, S-612 43 Finspång, Sweden

[21] Appl. No.: 793,867

[22] PCT Filed: Sep. 25, 1995

[86] PCT No.: PCT/SE95/01104

§ 371 Date: Mar. 11, 1997

§ 102(e) Date: Mar. 11, 1997

[87] PCT Pub. No.: WO96/09922

PCT Pub. Date: Apr. 4, 1996

[30] Foreign Application Priority Data

Sep. 29, 1994 [SE] Sweden ..... 9403308

[51] Int. Cl.[6] ..... B27L 7/00

[52] U.S. Cl. ..... 144/195.7; 144/193.1; 144/195.5

[58] Field of Search ..... 254/104; 144/193.1, 144/195.5, 195.7

[56] References Cited

U.S. PATENT DOCUMENTS

| | | | |
|---|---|---|---|
| 3,982,572 | 9/1976 | Kontendick | 144/195.7 |
| 4,033,390 | 7/1977 | Pointkowski | 144/195.7 |
| 4,211,264 | 7/1980 | Cross | 144/195.7 |
| 4,274,458 | 6/1981 | Dueweke et al. . | |
| 4,294,298 | 10/1981 | Otte, Jr. . | |
| 4,362,194 | 12/1982 | Lawson | 144/195.5 |
| 4,905,746 | 3/1990 | Bédard et al. . | |
| 5,495,878 | 3/1996 | McKenen, Jr. | 144/195.5 |

FOREIGN PATENT DOCUMENTS

| | | |
|---|---|---|
| 2 524 382 | 10/1983 | France . |
| 2 541 173 | 8/1984 | France . |

*Primary Examiner*—W. Donald Bray
*Attorney, Agent, or Firm*—Burns, Doane, Swecker & Mathis, L.L.P.

[57] ABSTRACT

The present invention relates to a hand-operated wood-splitter with striking weight (1) movable along a rod (2) connected at its lower end to an axe or splitting wedge (5). The invention is characterized in that the rod (2) for the striking weight (1) is provided at its upper end with a stop nut or other stop means (12). The axe, etc. is secured to a swinging arm (8) movable along a second rod (7) and rotatable around this. This latter rod is secured to a stamp (10) or a stand. At the lower end of the rod for the striking weight is a nut or ring which is movable to a limited extent in vertical direction in order to reduce the stresses.

8 Claims, 1 Drawing Sheet

HAND-DRIVEN WOOD SPLITTER

TECHNICAL FIELD

The present invention relates to a hand-operated wood-splitter with striking weight movable along a rod connected at its lower end to an axe or splitting wedge against which the striking weight is intended to strike.

BACKGROUND ART

Splitting wood in the traditional manner is not without risk and various constructions have therefore been invented in order to eliminate these risks. A drawback of these constructions is that they are far too expensive to suit people requiring only small quantities of fire-wood.

The first paragraph above describes a construction already known (FR 2541173) which offers increased safety for the user. However, its drawbacks include it being impossible to easily remove the axe when it has become lodged in the chunk of wood. Another drawback is that this wood-splitter does not have an arrangement for splintering wood to kindle a fire.

DESCRIPTION OF THE INVENTION

The object of the invention is a device in which the advantages of the known arrangement are exploited, while at the same time the disadvantages are eliminated. The wood-splitter according to the invention is characterized in that the rod is provided at its upper end with a stop nut or other stop means so designed that a stroke from below by the striking weight facilitates removal of the axe from the wood, and that the axe (splitting-wedge) is secured to a side grip movable along a second rod secured at its lower end to a stump or a stand, the side grip and the axe being rotatable around said second rod, and in that a nut or ring is also secured at the lower end of the rod for the striking weight, said nut or ring being movable to a limited extent in vertical direction in order to reduces the stresses. Thanks to the forced guiding of the striking weight, the arrangement is substantially risk-free and, by rapidly moving the striking weight back towards the top nut, etc., the axe is also removed from the chunk of wood where it has lodged—this also without risk and using little energy. The nut or ring, movable to a limited extent, which is located at the lower end of the rod for the striking weight, provides an extra force, i.e. an extra "push-off" at the start of the upward stroke, thereby increasing efficiency and reducing stresses.

In a preferred embodiment of the invention the side grip is provided with a cutting edge whereby, with the assistance of the striking weight, possibly after swinging the side grip about the rod, wood for kindling a fire can be splintered. This advantage is not shown within the known technology and enables this phase also to be performed without risk through forced guiding.

BRIEF DESCRIPTION OF THE DRAWINGS

The invention is described in more detail in the accompanying drawings in which.

DESCRIPTION OF EMBODIMENT

Figure 1:
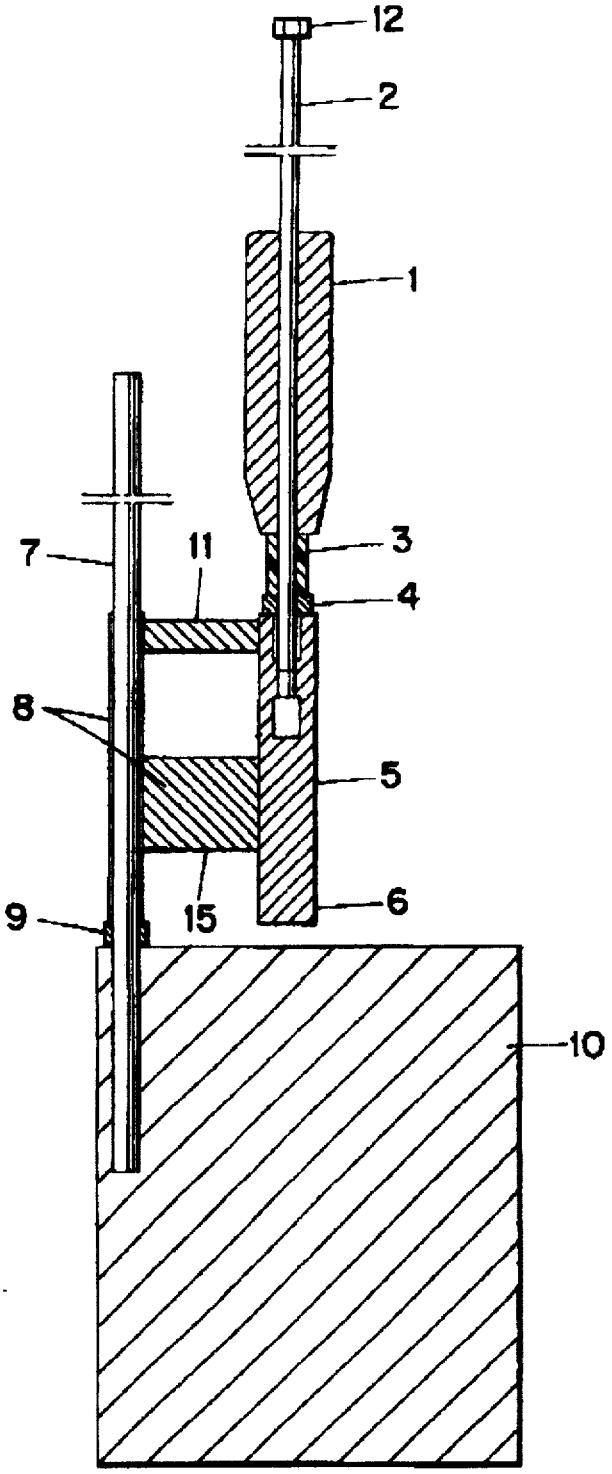
FIG. 1 shows a view from the side of a hand-operated wood-splitter and FIG. 2 shows a detail of the invention.
Figure 2:
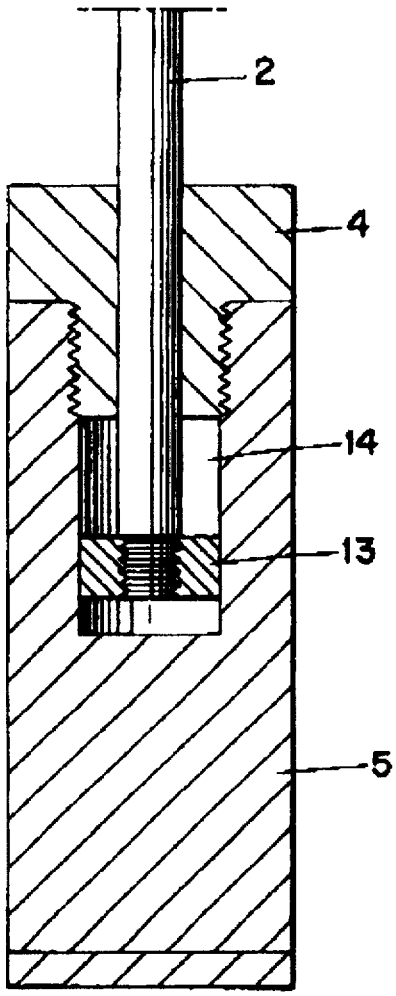

FIG. 1 shows the wood-splitting equipment seen from the side. It comprises a stump or stand (10) and an axe or splitting-wedge (5) with a cutting edge (6) for splitting chunks of wood or other pieces of wood. The wood-splitter also includes a striking weight (1) weighing for instance 4 kg, movable along a rod (2) which is secured at its lower end to the axe (splitting-wedge 5) via a plastic washer (3) and a bolt (4). The axe (splitting-wedge) is supported by a side grip (8) provided at its lower end with a cutting edge (15) for splintering kindling. The side grip with axe is rotatable about and slidable along a second rod (7), together with a handle (11). (9) denotes tightening washers.

In order to chop wood the apparatus is lifted by means of the handle (11) and the axe turned to splitting position above a chunk of wood, in contact therewith. The striking weight (1) is then raised and forced down towards the axe (5) which thus acquires considerable force for splitting the log. The forced guiding prevents the operator from sustaining any injuries. If the axe lodges in the log, the striking weight (1) can be forced up towards the stop nut (12) and the axe easily removed without requiring great force.

In order to splinter kindling the apparatus is raised by means of the handle (11) and a piece of wood placed below the cutting edge (15) of the side grip (8). Splintering can then be performed with the aid of the striking weight.

In order to reduce stresses in the apparatus during the various strokes, a nut (13) has been placed at the lower end of the rod (2) for the striking weight, said nut being movable to a limited extent (14) in vertical direction for the purpose of reducing stresses in the apparatus. A hole, 120 mm for instance, can be drilled in the stump (1) for the second rod (7). A stand or the like may be used instead of a stump in order to secure the second rod.

The invention can be varied in many ways within the scope of the following claims.

I claim:

1. A hand-operated wood-splitter comprising:

a striking weight movable along a first rod;

a splitting wedge against which the striking weight is intended to strike, a lower end of the first rod being connected to the splitting wedge; and a side grip movable along a second rod secured at its lower end to a stand, the splitting wedge being secured to the side grip, and the side grip and the splitting wedge being rotatable around said second rod, wherein a ring is secured at the lower end of the first rod for the striking weight, said ring being movable to a limited extent in vertical direction in a recess in the splitting wedge in order to reduce the stresses and increase efficiency.

2. A hand-operated wood-splitter as claimed in claim 1, wherein the first rod for the striking weight is provided at its upper end with a stop means so designed that a stroke from below by the striking weight facilitates removal of the splitting wedge from the wood.

3. A hand-operated wood-splitter as claimed in claim 1, wherein the side grip is provided at its lower end with a cutting edge for splintering wood under the influence of the striking weight.

4. A hand-operated wood-splitter as claimed in claim 2, wherein the side grip is provided at its lower end with a cutting edge for splintering wood under the influence of the striking weight.

5. A hand-operated wood-splitter as claimed in claim 1, wherein said splitting wedge comprises an axe.

6. A hand-operated wood-splitter as claimed in claim 1, wherein said stand comprises a stump.

7. A hand-operated wood-splitter as claimed in claim 1, wherein said ring secured to the lower end of the first rod comprises a nut.

8. A hand-operated wood-splitter as claimed in claim 2, wherein said stop means comprises a stop nut.

* * * * *